US009927105B2

(12) United States Patent
Brown et al.

(10) Patent No.: US 9,927,105 B2
(45) Date of Patent: Mar. 27, 2018

(54) LIFT ASSEMBLY AND RELATED METHOD

(71) Applicants: Raymond Brown, Modesto, CA (US); Manuel Lopez, Lodi, CA (US)

(72) Inventors: Raymond Brown, Modesto, CA (US); Manuel Lopez, Lodi, CA (US)

(73) Assignee: USA PRODUCTS GROUP, Lodi, CA (US)

( * ) Notice: Subject to any disclaimer, the term of this patent is extended or adjusted under 35 U.S.C. 154(b) by 363 days.

(21) Appl. No.: 14/806,609

(22) Filed: Jul. 22, 2015

(65) Prior Publication Data

US 2017/0023217 A1 Jan. 26, 2017

(51) Int. Cl.
*F21V 21/16* (2006.01)
*F21V 21/38* (2006.01)

(52) U.S. Cl.
CPC ..... *F21V 21/16* (2013.01); *F21V 21/38* (2013.01)

(58) Field of Classification Search
CPC ..... F21V 21/145; F21V 21/16; F21V 21/38; F16M 13/022; F16M 13/027; B66D 3/06; B66D 3/08; B66D 3/10; B66D 2700/028
See application file for complete search history.

(56) References Cited

U.S. PATENT DOCUMENTS 3,958,116 A * 5/1976 Jones ..... F21V 21/38 362/401
5,570,546 A * 11/1996 Butterworth ..... E04H 12/34 343/890
5,904,867 A * 5/1999 Herke ..... B23K 26/04 219/121.6
6,464,190 B1 * 10/2002 Aramaki ..... F21V 21/38 248/327
9,302,190 B1 * 4/2016 Jennings ..... A63J 5/00
2005/0104053 A1 * 5/2005 Miller ..... B66D 3/18 254/385
2006/0079357 A1 * 4/2006 Bowman ..... B63H 9/10 474/64
2009/0127527 A1 * 5/2009 Hoffend, III ..... A63J 1/028 254/338
2012/0060416 A1 * 3/2012 Brusatore ..... A01G 31/06 47/62 A
2013/0043450 A1 * 2/2013 Kommer ..... B66D 3/10 254/391

* cited by examiner

*Primary Examiner* — Emmanuel M Marcelo

(57) ABSTRACT

A lift assembly having, among other things, a control mechanism in combination with multiple directional devices to facilitate efficient, versatile, and precise incremental leveling, securing, rising, and lowering of a platform, is disclosed herein.

14 Claims, 4 Drawing Sheets

LIFT ASSEMBLY AND RELATED METHOD

BACKGROUND

The present disclosure relates generally to a lift assembly, and more particularly to a lift assembly having, among other things, a control mechanism in combination with multiple directional devices to facilitate efficient, versatile, and precise incremental leveling, securing, rising, and lowering of a platform.

Lift assemblies have found useful application with horticulturists for indoor growing of among other things, plants, fruits, herbs, and vegetables. In this regard, indoor plant growth for decorative, food source, medicinal, or other purposes has become a very sophisticated activity with many improvements over the last decade. In addition to water and nutrients, light is an important element in the growth of plants. It has long been a common practice to use artificial light to mimic the natural outdoor light for indoor growing operations. Application of artificial light has been refined to such an extent that light, temperature, light wavelength, duration of the applied light, and the height in which the light is introduced above the desired target have all been studied and refined. Accordingly, the height of the light from the plant is critical, and continued fine adjust is often needed to maximize plant growth. It is not uncommon to adjust the height of the light source on a daily basis, all in an effort to maximize the growth cycle.

Currently, there are several different lift devices or assemblies on the market that allow the user to manually adjust the height of the artificial light relative to the plant. One such method utilizes a pair of locking rope device. In these assemblies the light is held in place and a pair of rope locking devices, common in the tie down industry or sold through hydroponic supply outlets, are secured to a platform having plants or other vegetation disposed thereon. The rope locking devices are positioned in such a manner to allow the user to lift and lower the platform. However, these devices require the user to adjust the height of a first end or side of the platform using one of the rope locking devices, and subsequently adjust the height of the opposite or second end or side of the platform using the other rope locking device. This method of height adjust places the platform at an angled position after the first end is lifted and before the second end can be lift, potentially causing any object positioned on the platform to fall off the platform.

Accordingly, there is a need for an improved lift assembly having, among other things, a control mechanism in combination with multiple directional devices to facilitate efficient, versatile, and precise incremental leveling, securing, rising, and lowering of a platform.

SUMMARY

For purposes of summarizing the disclosure, exemplary concepts have been described herein. It is to be understood that not necessarily all such concepts may be achieved in accordance with any particular embodiment. Thus, for example, those skilled in the art will recognize that embodiments may be carried out in a manner that achieves or optimizes one concept as taught herein without necessarily achieving other concepts as may be taught or suggested herein.

In one embodiment, a lift assembly comprises a control mechanism; multiple directional devices including a first directional device, a second directional device, and a third directional device; and a platform, wherein each of the control mechanism and multiple directional devices are connected by a first strap and a second strap in a two-by-two quadrant lift configuration, the control mechanism and one directional device positioned in upper quadrants, and the platform attached to the other two directional device in the lower quadrants, to facilitate level incremental rising and lower of the platform.

In another embodiment, a lift assembly method of lifting a platform comprises routing a first strap and a second strap in a lift assembly having a control mechanism and three directional device formed in a two-by-two quadrant lift configuration, wherein the control mechanism and one directional device positioned in upper quadrants, and the other two directional device in the lower quadrants; attaching a platform to the first directional device and the third directional device; and simultaneously applying a force to the first strap and second strap to facilitate level incremental rising and lower of the platform.

These and other embodiments will become apparent to those skilled in the art from the following detailed description of the various embodiments having reference to the attached figures, the disclosure not being limited to any particular embodiment.

DETAILED DESCRIPTION

Figure 1:
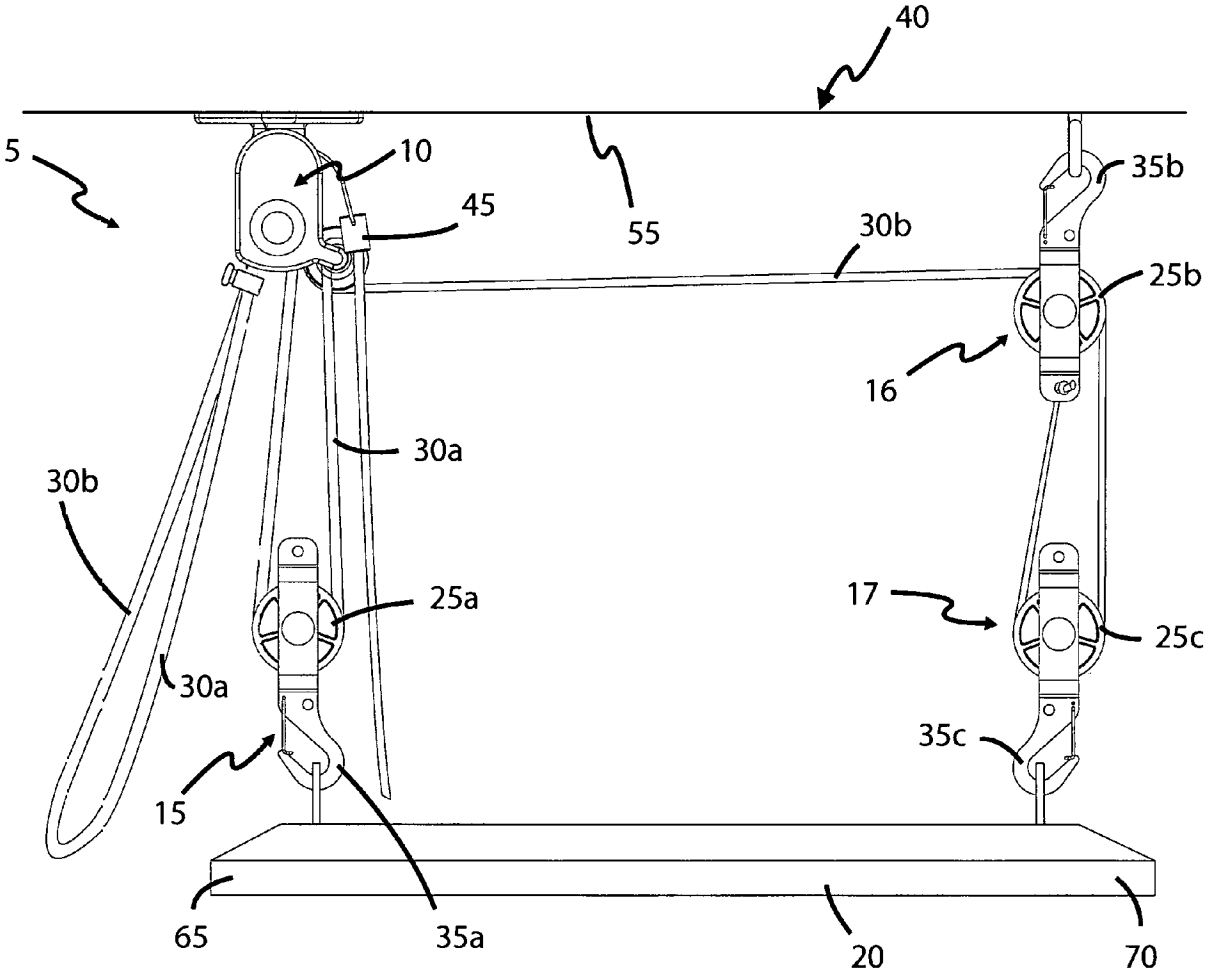
FIG. 1 shows a perspective view of a lift assembly in accordance with one embodiment disclosed herein.

Exemplary embodiments will now be described with references to the accompanying figures, wherein like reference numbers refer to like elements throughout. The terminology used in the description presented herein in not intended to be interpreted in any limited or restrictive manner simply because it is being utilized in conjunction with a detailed description of certain embodiments. Furthermore, various embodiments (whether or not specifically described herein) may include novel features, no single one of which is solely responsible for its desirable attributes or which is essential to practicing any of the embodiments herein described.

The present disclosure relates generally to a lift assembly, and more particularly to a lift assembly having, among other things, a control mechanism in combination with multiple directional devices to facilitate efficient, versatile, and precise incremental leveling, securing, rising, and lowering of a platform.

As used herein, the term "hub" is intended to include a spindle, a spool, a sheave, or a similar type article(s) that is configured or may be adapted to permit rotation and facilitate movement of a "strap" used for the purpose of leveling, securing, rising, and lowering a "platform".

As used herein, the term "strap" is intended to include a line, a rope (round synthetic, natural fiber, metal), a cable, a cord, a flat line (webbing), an anchor line or tensioning line, or a similar type of article(s) that may be adapted to be used with the lift assembly disclosed herein for the purpose of leveling, securing, rising, and lower a platform.

As used herein, in one embodiment the term "platform" is intended to include any surface that is generally used to hold or otherwise have position thereon items of one form or another including, but not limited to plants, fruits, herbs, and vegetables positioned below a light source. In another embodiment, platform may refer to a "light source" positioned above items including but not limited to plants, fruits, herbs, and vegetables.

Various parts, elements, components, etc, of the lift assembly disclosed herein may be constructed from metal, plastic, composite, or other suitable material or combination thereof for providing a sturdy and reliable structure for the purpose of leveling, securing, rising, and lowering a platform.

The actual size and dimension of any and all of the various parts, elements, components, etc., may vary depending on various factors including, among other things, intending application or usage of the lift assembly, as well as the size of the platform and/or items placed thereon and intended to be leveled, secured, raised, and lowered.

Connection(s) between the various parts, elements, components, etc., of the lift assembly may be accomplished using a variety of methods or processes. As such, the connections, whether integral and created via bending, or form molding, for example, or connected via bonding, hardware (nuts, bolts, washers, etc.), welding, or similar techniques, are well known in the art and omitted for simplicity.

Figure 4:
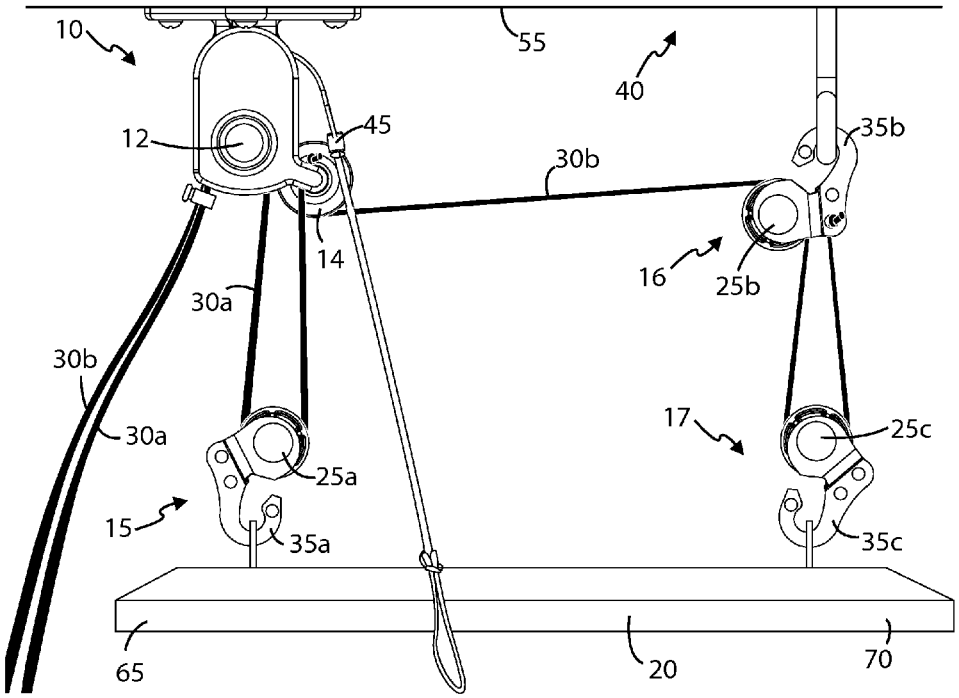
FIG. 4 shows another perspective view of a lift assembly in accordance with another embodiment disclosed herein.

FIG. 1 and FIG. 4 each show a lift assembly 5 in accordance with an embodiment disclosed herein. In this regard, the general features of the lift assembly 5 disclosed below relative to FIG. 1 apply equally to the lift assembly disclosed relative to FIG. 4 with each including multiple directional device with the directional devices of FIG. 1 being of a linear configuration (structure) and the directional devices of FIG. 4 being an L-shape configuration (structure).

The subject matter of the lift assembly 5 is disclosed below with a platform 20 configured to hold various forms of plants (not shown) positioned below a light source 55. In this regard, the lift assembly 5 is configured to precisely level, secure, rise, and lower the platform 20 relative to the light source 55. However, in another embodiment, the platform 20 may be the light source 55 or configured to include or incorporate a light source 55. Accordingly, the lift assembly 5 may be configured to precisely level, secure, rise, and lower the light source 55 relative to the various forms of plants positioned below the platform 55 (light source).

The lift assembly 5 may include a control mechanism 10 in combination with a multiple directional devices 15, 16, 17 to facilitate efficient, versatile, and incremental leveling, securing, rising, and lowering of a platform 20. In the embodiment disclosed herein, three directional device having substantially the same in size, structure, and function are utilized, but persons of ordinary skill in the art will understand that the directional devices may be of different sizes and still provide the benefits and functionality of the lift assembly as disclosed herein.

Figure 2:
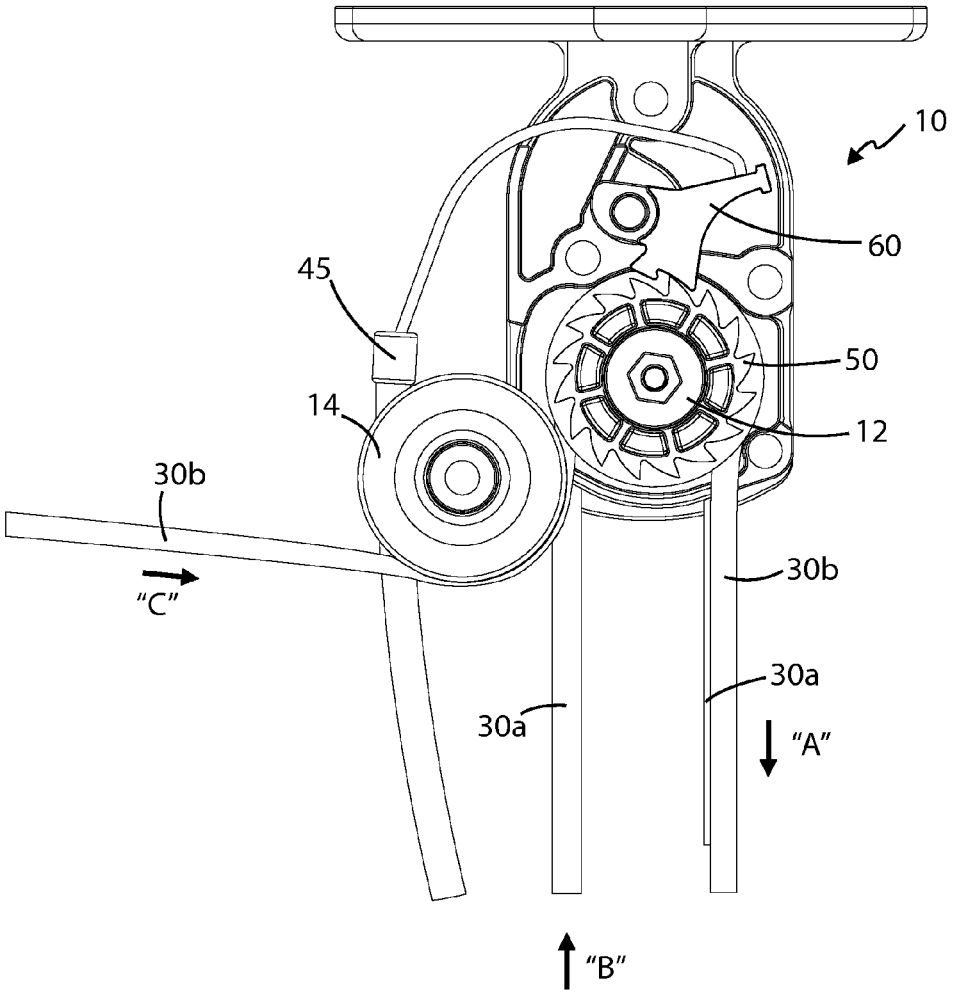
FIG. 2 shows a cut-away view of a control mechanism of the lift assembly of FIG. 1 in accordance with one embodiment disclosed herein.
Figure 3:
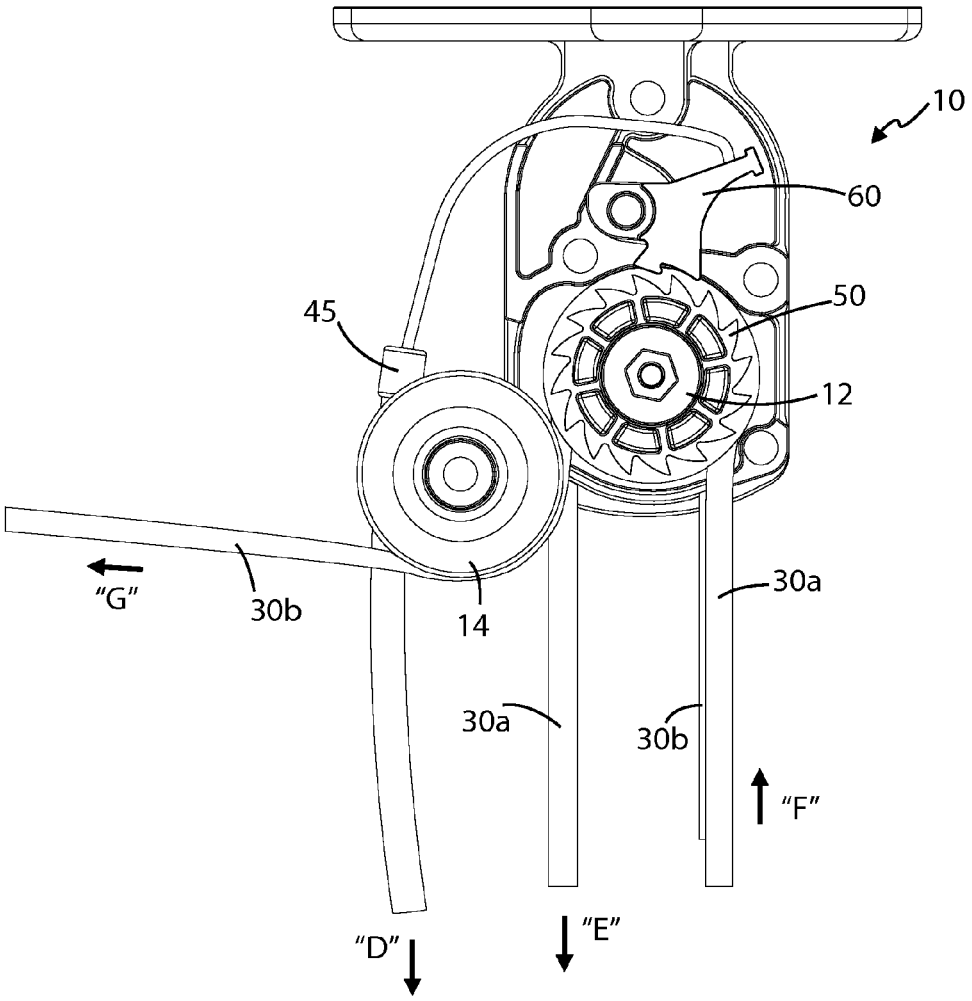
FIG. 3 shows another cut-away view of a control mechanism of the lift assembly of FIG. 1 in accordance with one embodiment disclosed herein.

In this regard, the lift assembly 5 may include a first directional device 15, a second directional device 16, and a third directional device 17. As shown in FIG. 2, in one embodiment, the control mechanism 10 may include an inner hub 12 and an outer hub 14 configured or adapted to permit rotation and facilitate movement of a first strap 30*a* and a second strap 30*b* used for the purpose of leveling, securing, rising, or lowering the platform 20. The control mechanism may further include a release-lock mechanism 45 (lanyard or other draw string type device) having a pawl 60 configured to release or lock the inner hub 12 in place to secure the platform 20 at a desired height or vertical elevation. In this regard, as shown in FIG. 2, the pawl 60 of the release-lock mechanism 45 is biased to engage teeth 50 on the inner hub 12 to prohibit rotation of the inner hub 12. As shown in FIG. 3, pulling on the first strap 30*a* and the second strap 30*b* disengages the pawl 60 of the release-lock mechanism 45 from the teeth 50 of the inner hub 12 permitting the inner hub 12 to rotate and allow precise incrementally leveling, raising and lowering of the platform 20 to a desired height the platform 20.

Each directional device 15, 16, 17 includes a corresponding hub 25*a*, 25*b*, 25*c* configured or adapted to permit rotation and facilitate movement of the first strap 30*a* or the second strap 30*b* used for the purpose of leveling, securing, rising, and lowering the platform 20, and a corresponding hook 35*a*, 35*b*, 35*c* or similar mechanism for attaching or otherwise securing the corresponding directional device 15-17 to the platform 20 or other stationary object 40 such as a ceiling or overhang.

As shown in FIG. 1 and FIG. 2, the first strap 30*a* may be routed over the inner hub 12 of the control mechanism 10, between the inner hub 12 and the outer hub 14 of the control mechanism 10, down toward and around the bottom of the hub 25*a* of the first directional device 15, and up to the outer hub 14 of the control mechanism 10 where the strap 30*a* is tied off or otherwise secured. The second strap 30*b* may be routed over the inner hub 12 of the control mechanism 10, between the inner hub 12 and the outer hub 14 of the control mechanism 10, toward and over the top of the hub 25*b* of the second directional device 16, down toward the hub 25*c* of the third directional device 17, around the bottom of the hub 25*c* of the third directional device, and up to the second directional device 16 where the strap 30*b* is tied off or otherwise secured. In this regard, the control mechanism 10 and the three multiple directional devices 15-17 may be connected by the first strap 30*a* and a second strap 30*b* in a two-by-two (2×2) quadrant lift configuration with the control mechanism 10 and one directional device 16 in upper quadrants, and the platform 20 attached to the other two directional devices 15, 17 in the lower quadrants.

As further shown in FIG. 1, the control mechanism 10 may be secured to a stationary object 40 such as a ceiling or overhang, while the first directional device 15 is positioned generally in a vertical direction from the control mechanism 10 and secured to a first end 65 of the platform 20. The second directional device 16 is positioned generally horizontal to the control mechanism 10 and secured to the stationary object 40, while the third directional device 17 is positioned generally in a vertical direction from the second directional device 16 and secured to a second end 70 the platform 20. A light source 55 is disposed on the stationary object 40 above the platform 20. Accordingly, the platform 20 is secured in a generally horizontal (level) position below the light source 55 by the control mechanism 10, and combination of first directional device 15, second directional device 16, and third directional device 17.

As shown in FIG. 2, due to the routing of the first strap 30*a* and second strap 30*b* as disclosed above, applying a force (pulling) to the first strap 30*a* and the second strap 30*b* in a direction shown by arrow "A" causes the first strap 30*a* to move in a direction generally shown by arrow "B", and the second strap 30*b* to move in a direction generally shown by arrow "C" to rise the platform in a precise incremental manner. Biasing of the pawl 60 of the release-lock mechanism 45 secures the platform 20 at the desired height and a distance relative to the light source 55. As shown in FIG. 3, applying a force (pulling) to the release-lock mechanism 45 in a direction generally shown by arrow "D" disengages the pawl 60 from the teeth 50 of the inner hub 12 permitting the inner hub 12 to rotate, the first strap 30*a* to move in a direction generally shown by arrows "E" and "F", the second strap 30*b* to move in a direction generally shown by arrow "G". Such an arrangement and routing of the first strap 30*a* and second strap 30*b* allows simultaneous precise incrementally leveling, raising and lowering of the first end 65 of the platform 20 and the second end 70 of the platform 20 to a desired height relative to the light source 55.

The first strap 30*a* and second strap 30*b* are in close proximity and can be easily handled by the user with one hand to either pull the straps 30*a*, 30*b* to raise up, or to feed in straps 30*a*, 30*b*, to lower the platform 20. When using similar sized directional devices 15-17, the position of the first end 65 of the platform 20 and second end 70 of the platform 20 simultaneously moves up or down in unison, thus, keeping the platform 20 level. Alternatively, if desired, either the first strap 30*a* or the second strap 30*b* could be move independently to alter the angle of the platform 20. The attachment points of the control mechanism 10 and directional devices 15-17 are adjustable to accommodate a variety of platforms and light fixture widths and shapes.

As disclosed herein, the release-lock mechanism 45 that, when pulled down, disengages a biased pawl 60 from the teeth 50 of inner hub 12 to allow free rotation of the inner hub 12 in both directions. Release of the release-lock mechanism 45 would reengage the biased pawl 60 into the inner hub 12 to prevent unwanted, downward movement of the platform 20 or light source 55. Therefore, pulling on the first strap 30*a* and the second strap 30*b* at the same time would result in raising the platform 20 or light source 55, and allow efficient, versatile, and precise incremental leveling, securing, rising, and lowering of the platform 20 or light source 55 by the user.

Conversely, lowering of the platform 20 or light source 55 device precisely done by providing an initial force on the release-load mechanism 45 to disengage the biased pawl 60 from the inner hub 12 then allowing the first strap 30*a* and the second strap 30*b* to route through the control mechanism 10 as the weight of the platform 20 of light source 55 provides tense to the straps 30*a*, 30*b* allowing precise lowering of the platform 20 or light source 55.

Accordingly, a lift assembly 5 method of lifting a platform 20 or light source 55 includes routing a first strap 30*a* and a second strap 30*b* in a lift assembly 5 having a control mechanism 10 and three directional device 15-17 formed in a two-by-two quadrant lift configuration, the control mechanism 10 and one directional device 16 positioned in upper quadrants, and the other two directional device in the lower quadrants; attaching a platform to the first directional device 15 and the third directional device 17; and simultaneously applying a force to the first strap 30*a* and second strap 30*b* to facilitate level incremental rising and lower of the platform 20.

The lift assembly method may further include positioning the first directional device 15 generally in a vertical direction from the control mechanism 10, securing the first directional device 15 to the platform 20, positioning the second directional device 16 generally horizontal to the control mechanism 10, securing the second directional device 16 to the stationary object 40 positioning the third directional device 17 generally in a vertical direction from the second directional device 16, and securing the third directional device 17 to the platform 20.

The lift assembly method may further include routing the first strap 30*a* through the control mechanism 10, down to the first directional device 15, back to the control mechanism 10, and securing the first strap 30*a* to the control mechanism 10, and routing the second strap 30*b* through the control mechanism 10, across to the second directional device 16, down to the third directional device 17, back to the second directional device 16, and securing the second strap 30*b* to the second directional device 16.

The lift assembly method may further include routing the first strap 30*a* over the inner hub 12 of the control mechanism 10, between the inner hub 12 and the outer hub 14 of the control mechanism 10, down toward and around the bottom of the hub 25*a* of the first directional device 15, and up to the outer hub 14 of the control mechanism 10 where the first strap 30*a* is secured, and routing the second strap 30*b* over the inner hub 12 of the control mechanism 10, between the inner hub 12 and the outer hub 14 of the control mechanism 10, toward and over the top of the hub 25*b* of the second directional device 16, down toward the hub 25*c* of the third directional device 17, around the bottom of the hub 25*c* of the third directional device 17, and up to the second directional device 16 where the second strap 30*b* is secured.

As such, the subject matter disclosed herein provides for an improved lift assembly having, among other things, a control mechanism in combination with multiple directional devices to facilitate efficient, versatile, and precise incremental leveling, securing, rising, and lowering of a platform.

Although the method(s)/step(s) are illustrated and described herein as occurring in a certain order, the specific order, or any combination or interpretation of the order, is not required. Obvious modifications will make themselves apparent to those skilled in the art, all of which will not depart from the essence of the disclosed subject matter, and all such changes and modifications are intended to be encompassed within the appended claims.

What is claimed is:

1. A lift assembly comprising:

a control mechanism;

multiple directional devices including a first directional device, a second directional device, and a third directional device; and a platform, wherein each of the control mechanism and multiple directional devices are connected by a first strap and a second strap in a two-by-two quadrant lift configuration, the control mechanism and the one directional device positioned in upper quadrants, and the platform attached to the other two directional device in lower quadrants to facilitate level incremental rising and lowering of the platform, wherein the first strap is routed through the control mechanism, down to the first directional device, and back to the control mechanism where the first strap is secured, and wherein the second strap is routed through the control mechanism, across to the second directional device, down to the third directional device, and back to the second directional device where the second strap is secured.

2. The lift assembly of claim 1, wherein the control mechanism is secured to a stationary object, the first directional device is positioned generally in a vertical direction from the control mechanism and secured to the platform, the second directional device is positioned generally horizontal to the control mechanism and secured to the stationary object, and the third directional device is positioned generally in a vertical direction from the second directional device and secured to the platform.

3. The lift assembly of claim 2, further including a light source disposed on the stationary object between the control mechanism and the second directional device.

4. The lift assembly of claim 1, wherein the control mechanism includes an inner hub, and outer hub configured to permit rotation and facilitate movement of the first strap and the second strap; and a release-lock mechanism having a biased pawl configured to release or lock the inner hub in place to secure the platform at a desired height.

5. The lift assembly of claim 1, wherein the each of the directional devices include a corresponding hub configured to permit rotation and facilitate movement of the first strap or the second strap; and a corresponding attachment mechanism for securing the corresponding directional device to the platform or a stationary object.

6. A lift assembly method of lifting a platform comprising:

routing a first strap and a second strap in a lift assembly having a control mechanism and multiple directional devices including a first directional device, a second directional device, and a third directional device formed in a two-by-two quadrant lift configuration, wherein the control mechanism and one directional device are positioned in upper quadrants, and the other two directional device are positioned in lower quadrants;

attaching the platform to the first directional device and the third directional device;

simultaneously applying a force to the first strap and second strap to facilitate level incremental rising and lowering of the platform, routing the first strap through the control mechanism, down to the first directional device, back to the control mechanism, and securing the first strap to the control mechanism, and routing the second strap through the control mechanism, across to the second directional device, down to the third directional device, back to the second directional device, and securing the second strap to the second directional device.

7. The lift assembly method of claim 6, further comprising:

positioning the first directional device generally in a vertical direction from the control mechanism;

securing the first directional device to the platform;

positioning the second directional device generally horizontal to the control mechanism;

securing the second directional device to a stationary object;

positioning the third directional device generally in a vertical direction from the second directional device; and securing the third directional device to the platform.

8. The lift assembly method of claim 7, further comprising:

disposing a light source on the stationary object between the control mechanism and the second directional device.

9. The lift assembly method of claim 7, wherein the platform is a light source.

10. The lift assembly method of claim 6, further comprising:

routing the first strap over an inner hub of the control mechanism, between the inner hub and an outer hub of the control mechanism, down toward and around a bottom of a hub of the first directional device, and up to the outer hub of the control mechanism where the first strap is secured, and routing the second strap over the inner hub of the control mechanism, between the inner hub and the outer hub of the control mechanism, toward and over a top of a hub of the second directional device, down toward a hub of the third directional device, around a bottom of the hub of the third directional device, and up to the second directional device where the second strap is secured.

11. A lift assembly comprising:

a control mechanism;

multiple directional devices including a first directional device, a second directional device, and a third directional device; and a platform, wherein each of the control mechanism and multiple directional devices are connected by a first strap and a second strap in a two-by-two quadrant lift configuration, the control mechanism and the one directional device positioned in upper quadrants, and the platform attached to the other two directional device in lower quadrants to facilitate level incremental rising and lowering of the platform, wherein the control mechanism includes an inner hub, and outer hub configured to permit rotation and facilitate movement of the first strap and the second strap; and a release-lock mechanism having a biased pawl configured to release or lock the inner hub in place to secure the platform at a desired height, and wherein the each of the directional devices include a corresponding hub configured to permit rotation and facilitate movement of the first strap or the second strap; and a corresponding attachment mechanism for securing the corresponding directional device to the platform or a stationary object.

12. The lift assembly of claim 11, wherein the control mechanism is secured to a stationary object, the first directional device is positioned generally in a vertical direction from the control mechanism and secured to the platform, the second directional device is positioned generally horizontal to the control mechanism and secured to the stationary object, and the third directional device is positioned generally in a vertical direction from the second directional device and secured to the platform.

13. The lift assembly of claim 12, wherein the first strap is routed through the control mechanism, down to the first directional device, and back to the control mechanism where the first strap is secured, and wherein the second strap is routed through the control mechanism, across to the second directional device, down to the third directional device, and back to the second directional device where the second strap is secured.

14. The lift assembly of claim 13, wherein the first strap is routed over the inner hub of the control mechanism, between the inner hub and the outer hub of the control mechanism, down toward and around a bottom of the hub of the first directional device, and up to the outer hub of the control mechanism where the first strap is secured, and wherein the second strap is routed over the inner hub of the control mechanism, between the inner hub and the outer hub of the control mechanism, toward and over a top of the hub of the second directional device, down toward the hub of the third directional device, around a bottom of the hub of the third directional device, and up to the second directional device where the second strap is secured.

* * * * *